US009871351B2

(12) United States Patent
Thomas et al.

(10) Patent No.: US 9,871,351 B2
(45) Date of Patent: Jan. 16, 2018

(54) WIRE GROUND ELECTRODE SPARK PLUG FOR SUPER FLOW

(71) Applicants: DENSO International America, Inc., Southfield, MI (US); DENSO CORPORATION, Kariya-shi, Aichi-ken (JP)

(72) Inventors: Christopher Thomas, Berkley, MI (US); Nicholas Polcyn, Commerce, MI (US); Jeongung Hwang, Northville, MI (US)

(73) Assignees: DENSO International America, Inc., Southfield, MI (US); DENSO CORPORATION, Kariya, Aichi-pref. (JP)

( * ) Notice: Subject to any disclaimer, the term of this patent is extended or adjusted under 35 U.S.C. 154(b) by 202 days.

(21) Appl. No.: 14/556,349

(22) Filed: Dec. 1, 2014

(65) Prior Publication Data

US 2016/0156158 A1 Jun. 2, 2016

(51) Int. Cl.

| | |
|---|---|
| ***H01T 13/32*** | (2006.01) |
| ***H01T 21/02*** | (2006.01) |
| ***H01T 13/16*** | (2006.01) |

(52) U.S. Cl.

CPC ..... *H01T 13/32* (2013.01); *H01T 13/16* (2013.01); *H01T 21/02* (2013.01)

(58) Field of Classification Search

CPC ..... H01T 13/32; H01T 13/16; H01T 21/02
See application file for complete search history.

(56) References Cited

U.S. PATENT DOCUMENTS

| | | | | |
|---|---|---|---|---|
| 5,091,672 | A | 2/1992 | Below | |
| 5,581,145 | A | 12/1996 | Kato et al. | |
| 5,697,334 | A | 12/1997 | Below | |
| 5,918,571 | A | 7/1999 | Below | |
| 6,060,822 | A * | 5/2000 | Krupa | H01T 13/20 313/138 |
| 6,104,130 | A | 8/2000 | Below | |
| 7,652,413 | B2 | 1/2010 | Kawashima | |
| 2009/0189503 | A1 | 7/2009 | Below | |
| 2010/0320894 | A1 | 12/2010 | Hartmann et al. | |

* cited by examiner

*Primary Examiner* — Anne Hines
(74) *Attorney, Agent, or Firm* — Harness, Dickey & Pierce, P.L.C.

(57) ABSTRACT

The present teachings provide for a spark plug for an internal combustion engine and a method of constructing the spark plug. The spark plug can include a housing, insulator, first electrode, and ground electrode. The housing can be configured to be coupled to the engine. The insulator can be received in the housing. The first electrode can be received in the housing and can be spaced apart from the housing by the insulator. The ground electrode can have a first end, second end, and base portion. The first and second ends can be coupled to the housing for thermal conduction with the housing. At least one of the first and second ends can be coupled to the housing for electrical conduction with the housing. The base portion can be spaced apart from the first electrode to define a spark plug gap between the first electrode and the base portion.

16 Claims, 4 Drawing Sheets

WIRE GROUND ELECTRODE SPARK PLUG FOR SUPER FLOW

FIELD

The present disclosure relates to wire ground electrodes for spark plugs for super flow.

BACKGROUND

This section provides background information related to the present disclosure which is not necessarily prior art.

Internal combustion engines convert chemical energy of a fuel into kinetic energy through combustion of the fuel within a combustion chamber. The expansion of the combustion gasses typically causes a piston to move linearly in a cylinder of the engine. The piston is coupled to a crankshaft configured to convert the linear motion of the piston into rotation of the crankshaft, though other types of engines, such as rotary or Wankel engines for example, can convert the expansion of the combustion gasses into rotational motion without a piston. The rotational motion of the crank can be used to do work such as provide rotary power to a set of wheels of a vehicle for example, or to rotate a rotor of a generator to produce electricity for example.

Internal combustion engines that use certain fuels, such as gasoline or natural gas engines for example, typically use a spark plug to trigger ignition and combustion of an air-fuel mixture that has been compressed in the combustion chamber by the piston. A spark plug typically includes a center electrode and a ground electrode spaced apart from the center electrode by a predetermined gap. The center electrode is typically connected to an electrical source and the ground electrode is connected to a grounding source. The electrical source is typically configured to create a voltage across the gap sufficient to cause electrical arcing, i.e. a spark, to form between the center electrode and the ground electrode when the piston has compressed the air-fuel mixture in the combustion chamber. The size, location, timing, and duration of the spark are designed to ignite the air-fuel mixture to initiate combustion within the combustion chamber. Complete combustion can be important for increasing fuel efficiency and power, and decreasing emissions.

The grounding electrode of traditional spark plugs is formed from a "J" shaped conductive piece typically having a rectangular cross-section. Traditional grounding electrodes can inhibit the flow of the air-fuel mixture to the gap, which can lead to incomplete or unstable combustion. Furthermore, the combustion can cause the temperature of the typical grounding electrode to rise, which can result in premature ignition of the air-fuel mixture. The typical "J" shaped ground electrode extends and terminates freely beyond the center of the center electrode, such that the arcing does not occur at the terminal end of the "J" shape. This configuration can cause some heat to flow from the point of arcing, toward the terminal end, instead of toward the housing. This can cause heat to build up between the terminal end and the point of arcing, which can result in premature ignition of the air-fuel mixture.

SUMMARY

This section provides a general summary of the disclosure, and is not a comprehensive disclosure of its full scope or all of its features.

The present teachings provide for a spark plug for an internal combustion engine including a housing, an insulator, a first electrode, and a ground electrode. The housing can be configured to be coupled to the internal combustion engine. The insulator can be received in the housing. The first electrode can be received in the housing and can be spaced apart from the housing by the insulator. The ground electrode can have a first end, a second end, and a base portion. The first and second ends can be coupled to the housing for thermal conduction with the housing. At least one of the first and second ends can be coupled to the housing for electrical conduction with the housing. The base portion can be spaced apart from the first electrode to define a spark plug gap between the first electrode and the base portion.

The present teachings further provide for a spark plug for an internal combustion engine including a housing, an insulator, a center electrode, and a ground electrode. The housing can define a central bore and a plurality of threads configured to engage a plurality of mating threads formed in the internal combustion engine to removably couple the housing to the internal combustion engine. The insulator can be received in the central bore. The center electrode can be received in the central bore and can be spaced apart from the housing by the insulator. The ground electrode can be formed of a round wire having a first end, a second end, and a base portion. The first and second ends can be welded to the housing for electrical and thermal conduction with the housing. The base portion can be supported by the first and second ends apart from the center electrode to define a spark plug gap between the center electrode and the base portion.

The present teachings further provide for a method of constructing a spark plug for an internal combustion engine. The method can include shaping a wire into an arcuate shape, welding a first end of the wire to a housing configured to be coupled to the internal combustion engine, welding a second end of the wire to the housing, and inserting a center electrode into a central bore of the housing.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
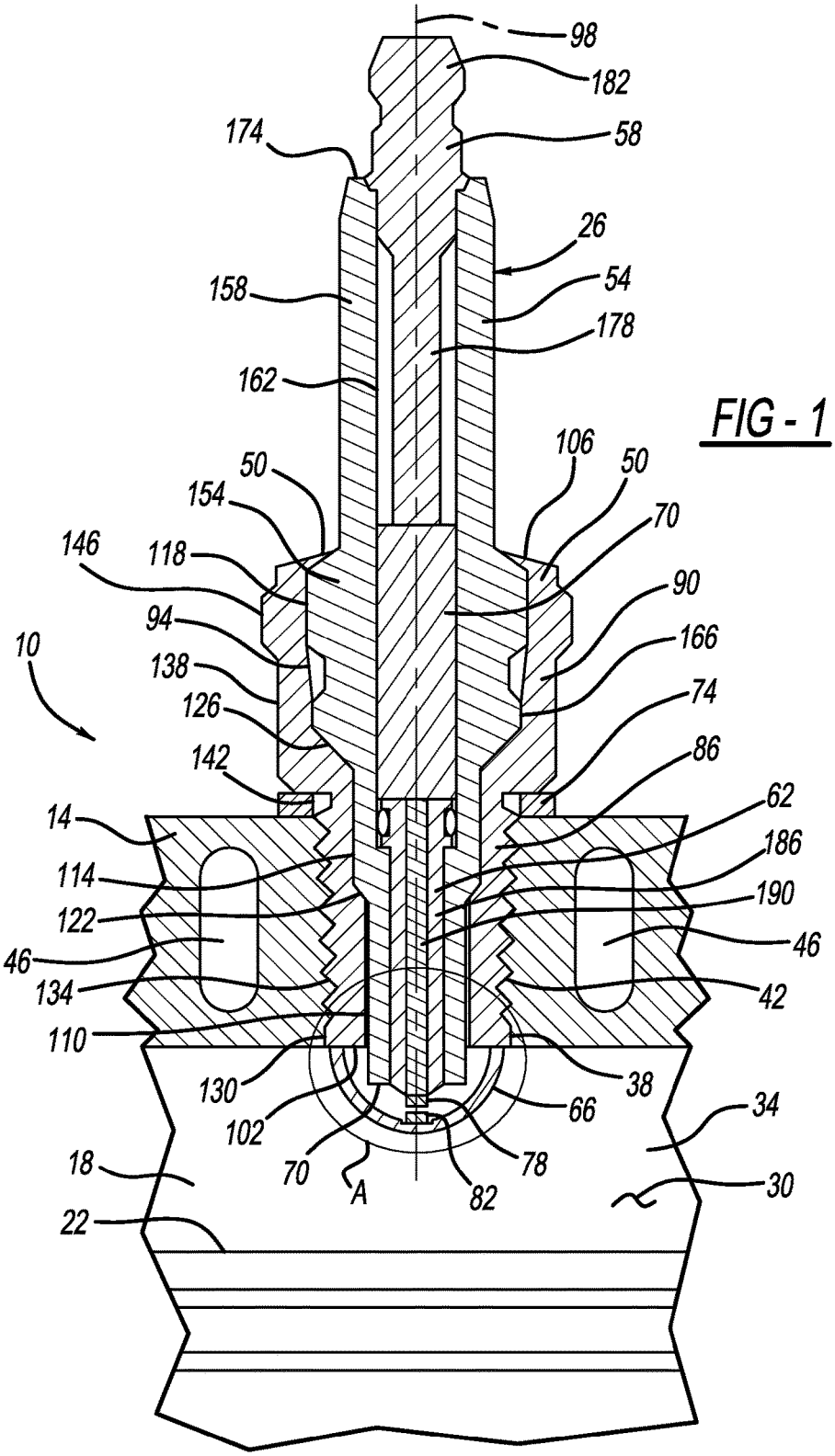
FIG. 1 is a sectional view of a portion of an internal combustion engine including a spark plug having a wire grounding electrode in accordance with the present teachings.

With reference to FIG. 1, a portion of an internal combustion engine 10 is illustrated. The internal combustion engine 10 can have an engine head 14, an engine block 18, a compression device 22, and a spark plug 26. The engine block 18 can define a cylinder 30. The compression device 22 can be a piston and can be slidably received in the cylinder 30. The engine head 14, engine block 18, and compression device 22 can define a combustion chamber 34. While only one cylinder 30 is illustrated, it is understood that the engine 10 can have any number of cylinders 30 and compression devices 22, in any number of orientations, such as an in-line 4 cylinder engine, or a V-8 cylinder engine for example. While the engine 10 is illustrated and described as a piston-cylinder engine, it is understood that the spark plug 26 can be used with other types of engines that compress an air-fuel mixture in a combustion chamber, such as rotary or Wankel engines for example.

The engine head 14 can be formed of a material that is both electrically and thermally conductive, such as aluminum, steel, or a metallic alloy for example. The engine head 14 can be electrically coupled to a grounding source (not shown), such as a vehicle body or negative terminal of a battery for example. The engine head 14 can define a plug bore 38 having a plurality of interior threads 42. The engine head 14 can define a cooling conduit 46. The cooling conduit 46 can be configured to allow engine coolant fluid to flow through the engine head 14 proximate to the plug bore 38. The cooling conduit 46 can form a "cooling jacket" that can surround the plug bore 38 to provide cooling on all sides of the plug bore 38. The engine coolant can absorb heat from the engine head 14 and release the heat away from the engine 10 at a heat exchanger (not shown), such as a radiator for example, in order to cool the engine head 14 and spark plug 26, as will be described below.

The spark plug 26 can include a housing 50, an insulator 54, a terminal 58, a center electrode 62, and a ground electrode 66. The spark plug 26 can also include a seal 70, and a gasket 74. The center electrode 62 can include a center electrode tip 78 and the ground electrode can include a ground electrode tip 82, as will be described below.

The housing 50 can include a first portion 86 and a second portion 90. The first portion 86 and second portion 90 can be unitarily formed of an electrically and thermally conductive material, such as a steel alloy for example. The housing 50 can define a central bore 94 that extends through the first and second portions 86, 90 along a central axis 98. The central bore 94 can vary in diameter along the length of the housing 50. In the example provided, the central bore 94 is narrowest proximate to a first end 102 of the housing at the first portion 86, and expands in a generally step-wise manner toward a second end 106 of the housing 50 at the second portion 90, though other configurations can be used. In the example provided, the central bore 94 includes a narrowest or first diameter section 110, an intermediate or second diameter section 114, and a wider or third diameter section 118, with ramped steps 122, 126 between each section 110, 114, 118, though other configurations can be used. The first diameter section 110 can be wholly within the first portion 86, the second diameter section 114 can span between the first and second portions 86, 90, and the third diameter section 118 can be wholly within the second portion 90, though other configurations can be used.

An outer diameter 130 of the first portion 86 can include a plurality of exterior threads 134 configured to matingly engage with the plurality of interior threads 42 of the plug bore 38 of the engine head 14. In this way, the first portion 86 can be screwed into the engine head 14 and be enveloped by the engine head 14. Contact between the outer diameter 130 of the first portion 86 and the engine head 14, and between the interior and exterior threads 42, 134 can allow for electrical and thermal conductivity between the housing 50 and the engine head 14.

An outer diameter 138 of the second portion 90 can be greater than the plug bore 38. The gasket 74 can be a ring shape with an inner diameter 142 greater than the outer diameter 130 of the first portion 86 and less than the outer diameter 138 of the second portion 90, and can be disposed about the first portion 86 proximate to the second portion 90 such that screwing the first portion 86 into the engine head 14 can cause the second portion 90 to compress the gasket 74 against the engine head 14 to form a seal therebetween. The outer diameter 138 of the second portion 90 can also define a tool surface 146, such as a hexagonal shape for example, configured to permit a tool (not shown) to grip the housing 50 to screw the housing 50 into the engine head 14. The second portion 90 can also include a flange 150 proximate to the second end 106 and configured to intrude radially into the central bore 94 to retain the insulator 54 within the central bore 94, as will be discussed below.

The insulator 54 can be formed of an electrically insulating and thermally conductive material, such as a high purity alumina material for example. The insulator 54 can have an interior portion 154 and an exterior portion 158 and can define an insulator bore 162 extending through the length of the insulator 54 along the axis 98. The interior and exterior portions 154, 158 can be unitarily formed of a single piece of material. An outer surface 166 of the interior portion 154 can generally contour with the varying diameter sections 110, 114, 118 and ramped steps 122, 126 of the central bore 94 of the housing 50. A first end 170 of the interior portion 154 can extend axially beyond the first end 102 of the housing 50, such that the first end 170 of the insulator 54 can extend into the combustion chamber 34 when the spark plug 26 is fully screwed into the engine head 14. The exterior portion 158 can be narrower than the third diameter section 118 of the housing 50 and a second end 174 of the exterior portion 158 can extend axially beyond the second end 106 of the housing 50. The flange 150 can protrude radially inward at the junction of the interior and exterior portions 154, 158 to retain the insulator 54 within the housing 50.

The terminal 58 can be formed of an electrically conductive material, such as a steel alloy for example. The terminal 58 can have a terminal stud 178 and a terminal head 182. The terminal stud 178 can be generally cylindrically shaped and can be received in the insulator bore 162. The terminal stud 178 can extend through the exterior portion 158 of the insulator 54 and into the interior portion 154 of the insulator 54, though other configurations can be used. The terminal head 182 can be generally bulb-shaped and extend axially beyond the second end 174 of the exterior portion 158 of the insulator 54. The terminal head 182 can be configured to accept and retain a high-tension cord (not shown) through which high-voltage current from an ignition system (not shown) of the engine 10 can flow to the terminal 58. While not specifically shown, the terminal head 182 can also include a terminal nut.

The seal 70 can be formed of a material configured to bond to the terminal stud 178 and the insulator 54, such as a material formed from a mixture of glass powder and copper powder for example. The seal 70 can be disposed radially between the terminal stud 178 and the insulator bore 162 and can form a seal therebetween. In the example provided, the seal 70 is disposed between the terminal stud 178 and the interior portion 154 of the insulator 54 within the second portion 90 of the housing 50, though other configurations can be used. In the example provided, the terminal stud 178 is coupled to the center electrode 62 at a portion of the insulator bore 162 sealed by the seal 70. The terminal stud 178 can transfer high-voltage current from the terminal head 182 to the center electrode 62.

The center electrode 62 can be formed of an electrically conductive material. In the example provided, the center electrode 62 has an outer shell 186 that is formed of a nickel alloy material, and has an inner core 190 formed of a copper material, though other configurations or materials can be used. The center electrode 62 can be received in the insulator bore 162 and can extend axially from within the first portion 86 of the housing 50, to beyond the first end 102 of the housing 50 and beyond the first end 170 of the insulator 54. In this way, the center electrode 62 can extend into the combustion chamber 34 when the spark plug 26 is fully screwed into the engine head 14. The center electrode 62 can also include the center electrode tip 78. The center electrode tip 78 can be formed of a precious metal material, such as iridium or platinum for example. In the example provided, the center electrode tip 78 is welded to the outer shell 186 of the center electrode 62 axially beyond the insulator 54.

Figure 2:
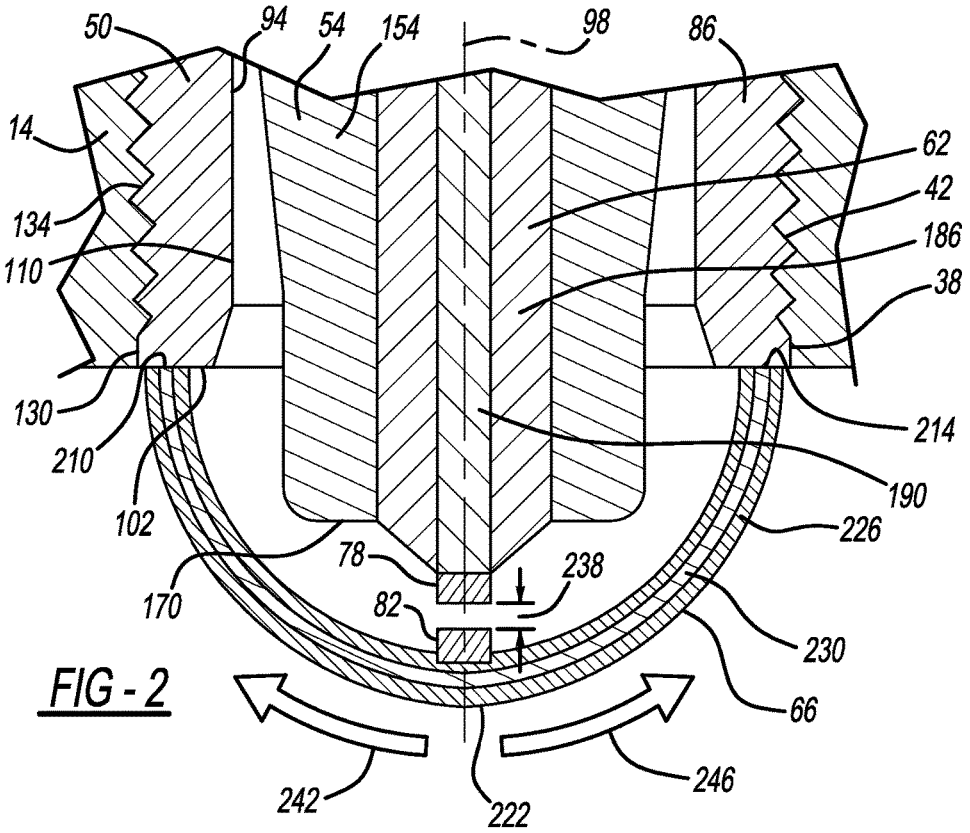
FIG. 2 is a close-up view of area A of FIG. 1.
Figure 3:
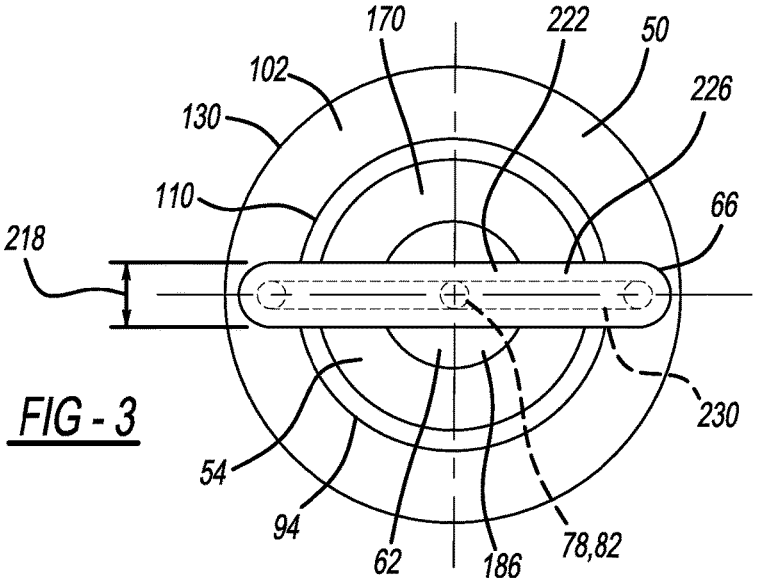
FIG. 3 is an elevated view of the spark plug of FIG. 1.

With additional reference to FIGS. 2 and 3, the ground electrode 66 can be formed of an electrically and thermally conductive material, such as a nickel alloy for example. The ground electrode 66 can be a wire formed into a generally "U" or arcuate shape having a first ground end 210 and a second ground end 214 forming the top of the "U" shape. The ground electrode 66 wire can have a circular, or round cross-section. The ground electrode wire can have a diameter 218 that can be as small as 0.5 mm and as large as the distance between the outer diameter 130 of the first portion 86 of the housing 50 and the first diameter section 110 of the central bore 94, depending on the application. The first ground end 210 can be coupled to the first end 102 of the housing 50 for electrical and thermal conductivity between the ground electrode 66 and the housing 50. The second ground end 214 can be coupled to the first end 102 of the housing 50 for electrical and thermal conductivity between the ground electrode 66 and the housing 50. The second ground end 214 can be coupled to the first end 102 of the housing 50 such that the first and second ground ends 210, 214 are on diametrically opposed sides of the housing 50. The ground electrode 66 can extend axially outward from the first end 102 of the housing 50 such that a curved central portion, or base 222 of the "U" shape can extend axially further into the combustion chamber 34 than the center electrode 62 when the spark plug 26 is fully screwed into the engine head 14.

The ground electrode 66 can include an outer wire 226 surrounding a core wire 230. The ground electrode 66 can also include the ground electrode tip 82. The outer wire 226 can be an alloy configured for withstanding high temperatures, such as an alloy including nickel, chrome, and/or platinum for example, though other alloys can be used. The core wire 230 can be a highly thermally conductive material, such as copper for example. The core wire 230 can extend the entire length of the ground electrode 66 from the first ground end 210 to the second ground end 214. The ground electrode tip 82 can be formed of a precious metal, such as iridium or platinum for example. In the example provided, the ground electrode tip 82 is welded to the base 222 of the "U" shape of the ground electrode 66, such that the ground electrode tip is centered on the axis 98 or aligned with the center electrode tip 78 and axially spaced apart from the center electrode tip 78 to define a gap 238. The gap 238 can be configured to permit electrical arcing, i.e. a spark, to form between the center electrode tip 78 and the ground electrode tip 82 when high-voltage current is supplied to the center electrode tip 78 from the terminal 58. The gap 238 can be the closest distance between the ground electrode 66 and the center electrode 62 such that arcing is prevented from occurring at other locations along the ground electrode 66. The ground electrode tip 82 can be a different diameter than the center electrode tip 78, depending on the application.

The "U" shaped ground electrode 66 can allow heat from the combustion to travel in two, opposite directions 242, 246 from the single ground electrode tip 82, into the housing 50, where the heat can then be transferred into the engine head 14 (FIG. 1) where it can be carried away by the coolant fluid flowing through the coolant conduit 46 (FIG. 1). The ground electrode 66 being directly welded to the first portion 86 of the housing 50 can allow the ground electrode 66 to be in close proximity to the threads 42, 134 of the housing 50 and the contact between the housing 50 and the engine head 14, minimizing the distance the heat must travel before being absorbed by the coolant fluid.

Furthermore, unlike traditional spark plug ground electrodes (not shown), since both ground ends 210, 214 are welded to the housing 50, the core wire 230 does not need to terminate within the outer wire 226 to prevent corrosion of the core wire 230 at the free end of the traditional ground electrode. Instead, the core wire 230 can extend throughout the entire length of the outer wire 226. In this way, the core wire 230 and outer wire 226 can contact the housing 50 in two distinct locations, on diametrically opposite sides of the housing 50 to allow more heat to transfer away from the ground electrode tip 82 than in traditional ground electrodes. In other words, a heat quenching effect of the ground electrode 66 is increased over traditional ground electrodes, which can result in a reduced chance of pre-ignition. This configuration also allows for the ground electrode 66 to be cut from a continuous wire of material, which can decrease manufacturing complexity, as will be discussed below.

Figure 4:
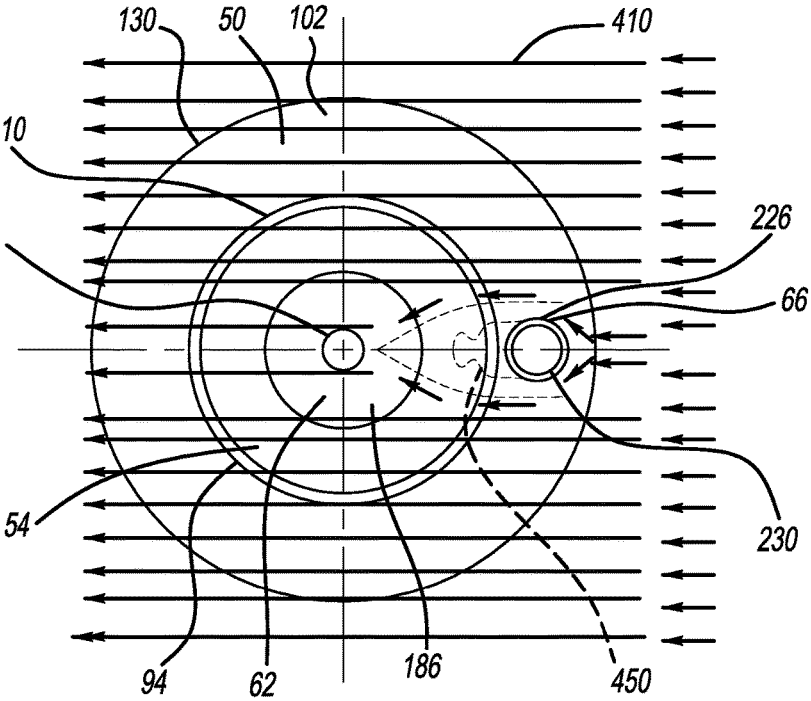
FIG. 4 is a diagram of air flow around the wire grounding electrode of FIG. 1.
Figure 5:
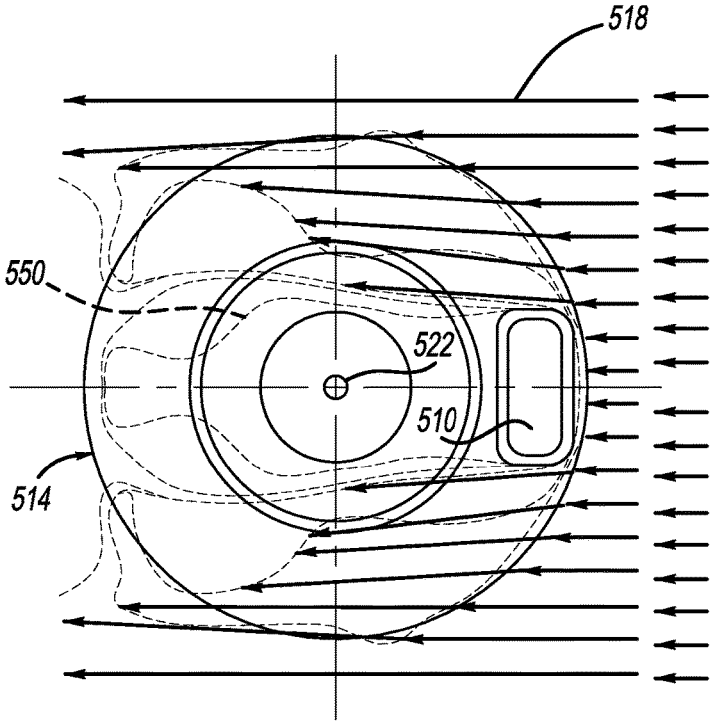
FIG - 5 Prior Art
FIG. 5 is a diagram of air flow around a traditional grounding electrode of the prior art.

With additional reference to FIG. 4, a flow pattern of an air-fuel mixture flowing around the ground electrode 66 is illustrated by arrows 410. The center electrode tip 78 and ground electrode tip 82 are located at center 414. With additional reference to FIG. 5, a flow pattern of an air-fuel mixture flowing around a traditional ground electrode 510 of a traditional spark plug 514 is illustrated by arrows 518. A location of a center electrode tip and ground electrode tip of the traditional spark plug 514 is shown at center 522. It is understood that the direction of the flow of the air-fuel mixtures 410, 518 relative to the ground electrodes 66, 510 can depend on the rotational position of the spark plug 26 relative to the engine head 14, which can depend on the threads 42, 134. Accordingly, a worst-case scenario can occur when the air-fuel mixtures 410, 518 directly impinge on the ground electrodes 66, 510 upstream of the centers 414, 522, as illustrated. An area of stagnation 450 of the flow of the air-fuel mixture 410 as a result of flowing past the ground electrode 66 is illustrated on FIG. 4. An area of stagnation 550 of the flow of the air-fuel mixture 518 as a result of flowing past the traditional ground electrode 510 is illustrated on FIG. 5. The round cross-sectional shape, and relatively smaller cross-sectional area of the ground electrode 66 can permit the air-fuel mixture 410 to flow smoothly around the ground electrode 66 such that the flow of the air-fuel mixture 410 can converge before reaching the center 414. In other words, the area of stagnation 450 behind the ground electrode 66 does not extend over the center 414 where arcing across the gap 238 occurs, thus improving proper ignition. In contrast, the area of stagnation 550 of the traditional ground electrode 510, having a rectangular shape and a larger cross-sectional area, can extend over the center 522 to inhibit proper ignition of the air-fuel mixture 518.

Figure 6:
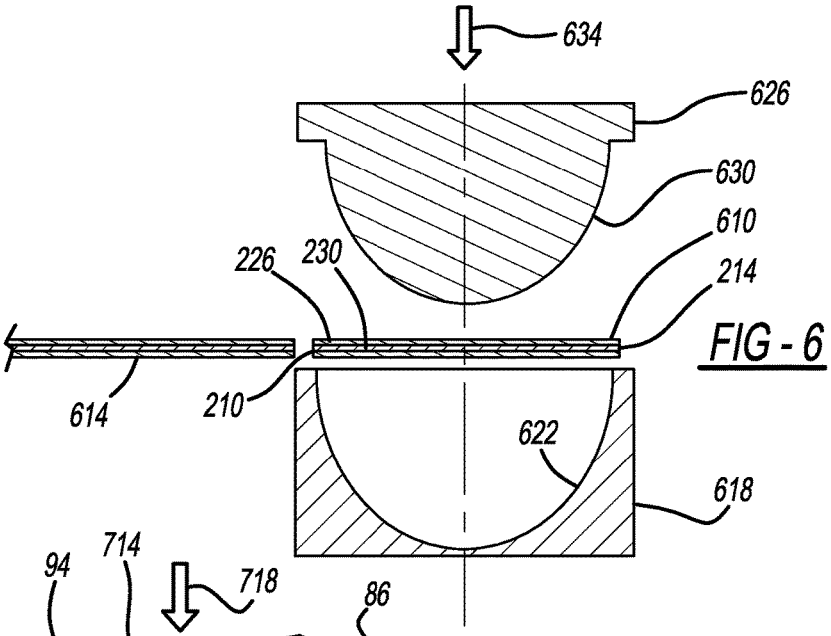
FIG. 6 illustrates a step in a method of manufacturing the spark plug and wire grounding electrode of FIG. 1.
Figure 7:
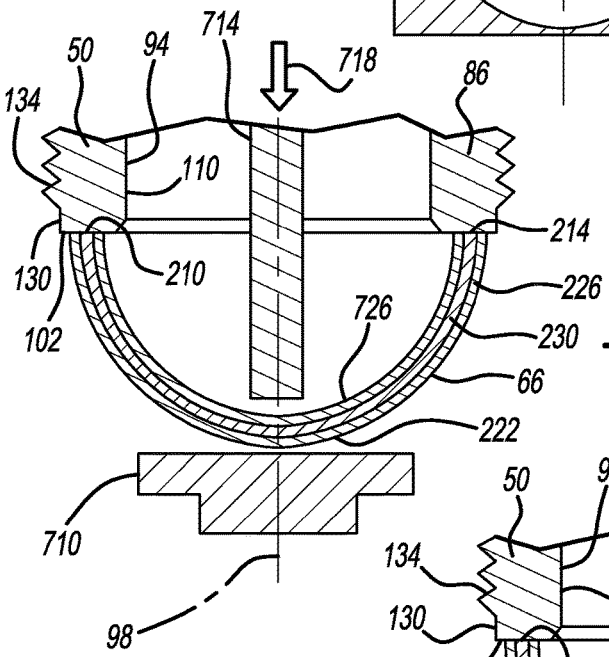
FIG. 7 illustrates another step in a method of manufacturing the spark plug and wire grounding electrode of FIG. 1.
Figure 8:
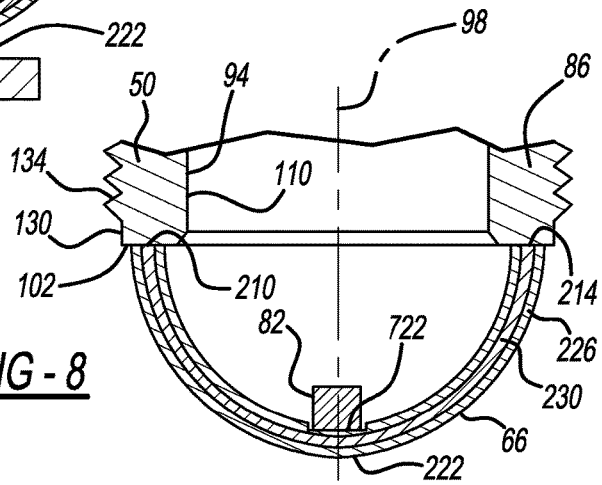
FIG. 8 illustrates another step in a method of manufacturing the spark plug and wire grounding electrode of FIG. 1.

With reference to FIGS. 6-8, steps in manufacturing the spark plug 26 and ground electrode 66 are illustrated. With specific reference to FIG. 6, a wire blank 610 can be cut from a continuous wire 614 which can be coiled or spooled on a spool (not shown) of the wire 614. The wire blank 610 will become the ground electrode 66. The wire 614 and wire blank 610 can include the outer wire 226 surrounding the core wire 230. As discussed above, the outer wire 226 can be an alloy configured for withstanding high temperatures, such as an alloy including nickel, chrome, and/or platinum for example, though other alloys can be used. The core wire 230 can be a highly thermally conductive material, such as copper for example. The core wire 230 can extend the entire length of the wire blank 610 from the first ground end 210 to the second ground end 214 and can extend the entire wire 614.

The wire blank 610 can be positioned in a first die 618 having a curved relief surface 622. A first press 626 can have a mating curved surface 630 and can be moved in the direction 634 to be received into the first die 618 to press the wire blank 610 between the first die 618 and the first press 626. The operation of pressing the wire blank 610 between the curved relief surface 622 of the first die 618 and the mating curved surface 630 of the first press 626 can shape the wire blank 610 into the curved shape of the ground electrode 66, as shown in FIG. 7. The curved shape can be a generally "U" or arcuate shape, as discussed above with reference to the ground electrode 66, having the first ground end 210 and the second ground end 214 forming the top of the "U" shape. The first press 626 can then be retracted from the first die 618 and the curved ground electrode 66 can be removed from the first die 618.

With specific reference to FIG. 7, the first ground end 210 and second ground end 214 can then be welded to the first end 102 of the housing 50. While not specifically shown, additional processes, such as deburring or cleaning for example can occur after cutting the wire blank 610 from the wire 614 and/or after pressing the wire blank 610 into the curved shape. In the example provided, the insulator 54 (FIG. 1), center electrode 62 (FIG. 1), terminal 58 (FIG. 1), and seal 70 (FIG. 1) have not been inserted into the central bore 94 of the housing 50, though other configurations can be used. In the example provided, the first and second ground ends 210, 214 are laser welded to the first end 102 of the housing 50, though other welding methods can be used, such as one of the first and second ground ends 210, 214 being resistance welded and the other of the first and second ground ends 210, 214 being laser welded for example.

After welding the ground electrode 66 to the housing 50, the ground electrode 66 can be positioned on a second die 710 and a second press 714 can be configured to move in the direction 718 to press a flat surface 722 (FIG. 8) in an interior side 726 of ground electrode 66, i.e. the side facing the first end 102 of the housing 50. The second press 714 can be configured to form the flat surface 722 at the base 222 of the "U" shape of the ground electrode 66, i.e. the portion of the interior side 726 furthest from the first end 102 of the housing 50 and centered on the axis 98. In the example provided, the second press 714 is configured to extend through the central bore 94 of the housing 50 to press the ground electrode 66 against the second die 710, though other configurations can be used. The second press 714 and second die 710 can be configured to form the flat surface 722 as a recess in the ground electrode 66, as shown in FIG. 8.

With specific reference to FIG. 8, after the flat surface 722 has been formed, the ground electrode tip 82 can be welded to the flat surface 722. The ground electrode tip 82 can be centered on the axis 98 and can extend from the flat surface, along the axis 98 toward the housing 50. After the ground electrode tip 82 is welded to the flat surface 722, the insulator 54 (FIG. 1), center electrode 62 (FIG. 1), terminal 58 (FIG. 1), and seal 70 (FIG. 1) can be inserted into the central bore 94 of the housing 50 such that the center electrode tip 78 and ground electrode tip 82 can define the gap 238. It is understood that the steps described above with reference to FIGS. 6-8 can be done a different order than described.

In summary, the construction of the ground electrode 66 according to the present teachings can reduce cost and ease manufacturing by allowing the ground electrode 66 to be cut and formed from the wire 614 without the need to terminate the core wire 230 within the outer wire 226. The ground electrode 66 can also increase the heat quenching effect by providing two paths in opposite directions for heat to dissipate away from the ground electrode tip 82. The ground electrode 66 can also improve ignition of the air-fuel mixture 410 by reducing the area of stagnation 450 of the air-fuel mixture 410 and improving flow of the air-fuel mixture 410 to the gap 238 where arcing occurs.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A spark plug for an internal combustion engine comprising:

a housing configured to be coupled to the internal combustion engine;

an insulator received in the housing;

a first electrode received in the housing and spaced apart from the housing by the insulator; and a ground electrode having a first end, a second end, and a base portion, the first and second ends being coupled to the housing for thermal conduction with the housing, at least one of the first and second ends being coupled to the housing for electrical conduction with the housing, the base portion being spaced apart from the first electrode to define a spark plug gap between the first electrode and the base portion;

wherein the first electrode includes a first electrode tip and the ground electrode includes a ground electrode tip, the first electrode tip and ground electrode tip are spaced apart to define the spark plug gap; and wherein the ground electrode tip is disposed on a flat surface that is formed in an interior side of the ground electrode by recessing the interior side at a position furthest from the housing.

2. The spark plug of claim 1, wherein the ground electrode has a round wire shape.

3. The spark plug of claim 1, wherein the first and second ends of the ground electrode are welded to the housing.

4. The spark plug of claim 3, wherein the first and second ends of the ground electrode are welded to the housing on diametrically opposite sides of the housing.

5. The spark plug of claim 1, wherein the ground electrode includes an outer wire and a core wire, the outer wire being formed of a first material, the core wire being formed of a second material and disposed within the outer wire, the second material being different from the first material.

6. The spark plug of claim 5, wherein the core wire extends the entire length of the outer wire.

7. The spark plug of claim 1, wherein the ground electrode forms a "U" shape or an arc shape extending axially away from the housing.

8. The spark plug of claim 1, wherein the first electrode tip and ground electrode tip are formed from a precious metal material.

9. The spark plug of claim 1, wherein the housing is formed of a single piece of material.

10. The spark plug of claim 1, wherein the housing defines a plurality of threads configured to engage a plurality of mating threads formed in the internal combustion engine to removably couple the housing to the internal combustion engine.

11. A spark plug for an internal combustion engine comprising:

a housing defining a central bore and a plurality of threads configured to engage a plurality of mating threads formed in the internal combustion engine to removably couple the housing to the internal combustion engine;

an insulator received in the central bore;

a center electrode received in the central bore and spaced apart from the housing by the insulator; and a ground electrode formed of a round wire having a first end, a second end, and a base portion, the first and second ends being welded to the housing for electrical and thermal conduction with the housing, the base portion being supported by the first and second ends apart from the center electrode to define a spark plug gap between the center electrode and the base portion;

wherein the center electrode includes a center electrode tip and the ground electrode includes a ground electrode tip, the center electrode tip and the ground electrode tip are spaced apart to define the spark plug gap; and wherein the ground electrode tip is disposed on a flat surface that is formed in an interior side of the ground electrode by recessing the interior side at a position furthest from the housing.

12. The spark plug of claim 11, wherein the ground electrode includes an outer wire and a core wire, the outer wire being formed of a first material, the core wire being formed of a second material and disposed within the outer wire, the second material being different from the first material.

13. The spark plug of claim 12, wherein the core wire extends the entire length of the outer wire and is configured to transfer heat from the ground electrode to the housing at two distinct locations.

14. The spark plug of claim 11, wherein the ground electrode forms a "U" shape or an arc shape extending axially away from the housing.

15. The spark plug of claim 11, wherein the center electrode tip and the ground electrode tip are formed of a precious metal material.

16. The spark plug of claim 11, wherein the housing is formed of a single piece of material.

* * * * *